US007567147B2

(12) United States Patent
Toujo et al.

(10) Patent No.: US 7,567,147 B2
(45) Date of Patent: Jul. 28, 2009

(54) DIRECTIONAL COUPLER

(75) Inventors: Atsushi Toujo, Yasu (JP); Kenji Ajioka, Sabae (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 479 days.

(21) Appl. No.: 10/596,286

(22) PCT Filed: May 31, 2005

(86) PCT No.: PCT/JP2005/006345

§ 371 (c)(1),
(2), (4) Date: Jun. 8, 2006

(87) PCT Pub. No.: WO2005/112186

PCT Pub. Date: Nov. 24, 2005

(65) Prior Publication Data

US 2008/0297272 A1 Dec. 4, 2008

(30) Foreign Application Priority Data

May 18, 2004 (JP) ..... 2004-148116
Mar. 11, 2005 (JP) ..... 2005-068773

(51) Int. Cl.
*H01P 5/18* (2006.01)
*H01P 3/08* (2006.01)

(52) U.S. Cl. ..... 333/116; 333/246

(58) Field of Classification Search ..... 333/116, 333/109, 246, 238
See application file for complete search history.

(56) References Cited

U.S. PATENT DOCUMENTS 5,006,821 A 4/1991 Tam
5,369,379 A 11/1994 Fujiki
5,742,210 A 4/1998 Chaturvedi et al.
6,342,681 B1 1/2002 Goldberger et al.
6,747,525 B2 * 6/2004 Iida et al. ..... 333/116
2001/0028283 A1 10/2001 Sasaki et al.
2002/0130733 A1 9/2002 Iida et al.
2003/0218516 A1 11/2003 Gilbert et al.

FOREIGN PATENT DOCUMENTS

DE 4241148 A1 6/1993
JP 05-160614 A 6/1993

(Continued)

OTHER PUBLICATIONS

Official communication issued in the counterpart European Application No. 05728022.4, mailed on Apr. 20, 2007.

(Continued)

*Primary Examiner*—Dean O Takaoka
(74) *Attorney, Agent, or Firm*—Keating & Bennett, LLP

(57) ABSTRACT

A directional coupler includes a laminate including a ground electrode substrate, a dielectric substrate that includes line electrodes thereon, a lead-out conductor substrate that includes lead-out conductors of the line electrodes, a ground electrode substrate, and a protection substrate. External electrodes for grounding, external electrodes for a main line, and external electrodes for a subordinate line are provided in the laminate. The inner line electrode and the outer line electrode preferably have a spiral or helical shape, and the corresponding currents are transmitted in the same direction through sections of these line electrodes that are adjacent and substantially parallel to each other.

18 Claims, 6 Drawing Sheets

FOREIGN PATENT DOCUMENTS

| | | | |
|---|---|---|---|
| JP | 07-131211 | A | 5/1995 |
| JP | 09-153708 | A | 6/1997 |
| JP | 11-168309 | A | 6/1999 |
| JP | 11-284413 | A | 10/1999 |
| JP | 3203253 | B2 | 6/2001 |
| JP | 2001-520468 | A1 | 10/2001 |
| JP | 2002-280810 | A | 9/2002 |
| JP | 2002-280812 | A | 9/2002 |

OTHER PUBLICATIONS

Official communication issued in the counterpart European Application No. 05728022.4, mailed on Jun. 21, 2007.
International Search Report issued in the corresponding International Application No. PCT/JP2005/006345 mailed on May 17, 2005.
Official Communication issued in Japanese Patent Application No. 2005-068773, mailed on Dec. 6, 2005.

* cited by examiner

DIRECTIONAL COUPLER

BACKGROUND OF THE INVENTION

1. Field of the Invention

The present invention relates to directional couplers, and in particular, relates to a directional coupler that only couples microwaves that propagate through a transmission line in a first direction and obtains an output proportional to the microwave power and that does not couple microwaves that propagate through the transmission line in a second direction opposite to the first direction.

2. Description of the Related Art

For example, as described in Japanese Unexamined Patent Application Publication No. 5-160614, waveguide circuits, which have been the predominant microwave circuits, require high precision machining and thus are not suitable for mass production and are expensive. Moreover, a problem has existed with waveguide circuits in that the outer dimensions and weights of the waveguide circuits are large. Thus, microstrips, which can be reduced in size and weight through the use of large-scale integration technology have been used in radios, BS receivers, and the like.

A conventional directional coupler composed of microstrips shown in FIG. 6 is disclosed in Japanese Unexamined Patent Application Publication No. 5-160614.

This directional coupler is a side-edge type coupler, which has a structure in which sections of respective stripline electrodes 81*a* and 82*a* of microstrips 81 and 82 are disposed close to each other for the length of λ/4 in the horizontal direction and the upper and lower surfaces of the microstrips 81 and 82 are covered with ground electrodes 83 and 84. In a coupled mode of the sections of the stripline electrodes 81*a* and 82*a* which are disposed close to each other, a first microwave power is input from a port 1 to the microstrip 81 functioning as a main line while a second microwave power, that is a fraction of the first microwave power, is generated in a port 3 of the microstrip 82 functioning as a subordinate line.

For example, as shown in FIG. 7, in a cellular phone unit, in order to keep the transmission power at a minimum level through the function of dividing high frequency signals into two components in the aforementioned directional coupler, a main line 70*a* of a directional coupler 70 is disposed between a transmission power amplifier 71 and an antenna 72 and one end of a subordinate line 70*b* is connected to an automatic gain control circuit 73 so that the automatic gain control circuit 73 adjusts the output of the transmission power amplifier 71.

With regard to cellular phone units and the like, an important issue is to minimize the size. Thus, the size of directional couplers has been required to be further reduced. However, in the directional coupler shown in FIG. 6, for example, λ/4 is 7.5 cm (on the condition that the specific inductive capacity is 1) at 1 GHz. Thus, the required minimum length of the sections disposed close to each other in the horizontal direction of the stripline electrodes 81*a* and 82*a* is 7.5 cm. Accordingly, the size of the substrate, which includes the stripline electrodes 81*a* and 82*a* thereon, becomes large. Moreover, for example, when respective substrates that include the ground electrodes 83 and 84 thereon are disposed and fastened with screws under and over the substrate, which includes the stripline electrodes 81*a* and 82*a* thereon, a problem arises in that a reduction in size is limited and the cost increases.

Accordingly, a directional coupler that is improved to solve the aforementioned problem is proposed in Japanese Unexamined Patent Application Publication No. 5-160614. In this directional coupler, ground electrode substrates that include ground electrodes thereon are alternately laminated with dielectric substrates on which a pair of stripline electrodes are provided so that the stripline electrodes are disposed close and parallel to each other in a spiral shape. Then, the corresponding stripline electrode components of the individual dielectric substrates are connected in series with each other through a pair of via holes that are close to each other so that the stripline electrodes have the length of a quarter of a wavelength.

In the improved directional coupler, the stripline electrodes having the length of a quarter of a wavelength are formed with the stripline electrode components and the via holes so that the stripline electrodes are divided into components on a plurality of laminated dielectric substrates. Thus, the size of the improved directional coupler can be small compared with that of the directional coupler shown in FIG. 6. However, even in the improved directional coupler, the total length of the stripline electrodes is required to be a quarter of a wavelength. Thus, the size of the directional coupler cannot be significantly reduced. Moreover, in general, side-edge type couplers have a problem in that it is difficult to achieve a high degree of coupling due to the characteristics of the distribution of a magnetic field around the stripline electrodes. The improved directional coupler uses side-edge coupling between a pair of stripline electrodes. Thus, the improved directional coupler has a problem in that it is difficult to achieve a high degree of coupling.

On the other hand, a directional coupler called a broad-side type coupler is proposed in Japanese Patent No. 3203253. In this directional coupler, spiral-shaped coupled lines are opposed to each other with dielectric layers therebetween so as to achieve coupling between the coupled lines. Since the inductance value of the coupled lines becomes high in the directional coupler, the directional coupler can be constructed with lines that are shorter than a quarter of a wavelength. Thus, the size can be readily reduced, and a high degree of coupling can be achieved with a small loss.

However, in the directional coupler disclosed in Japanese Patent No. 3203253, since spiral-shaped coupled lines are opposed to each other with dielectric layers therebetween so as to achieve coupling between the coupled lines, the capacitance between the coupled lines becomes large. Thus, the directional coupler has a problem in that high isolation between the coupled lines cannot be achieved.

Moreover, in the directional couplers disclosed in Japanese Unexamined Patent Application Publication No. 5-160614 and Japanese Patent No. 3203253, coupling is adjusted by adjusting the distance between lines. In this case, a magnetic field and an electric field around the lines are both changed by adjusting the distance between the lines, and it is impossible to adjust only one of the magnetic field and the electric field. Thus, it is difficult to adjust isolation. Isolation is a phenomenon in which magnetic field coupling and electric field coupling nullify each other. Thus, isolation has been adjusted only by selecting types of materials of substrates on which coupled lines are provided to change the permittivity and the permeability.

SUMMARY OF THE INVENTION

In order to overcome the problems described above, preferred embodiments of the present invention provide a small directional coupler that has a high coupling value and high isolation characteristics.

In order to achieve this, a directional coupler according to a first preferred embodiment of the present invention includes at least one dielectric layer and two line electrodes that are provided on the at least one dielectric layer. The two line electrodes include an inner line electrode and an outer line electrode that surrounds the inner line electrode, as viewed from above. Corresponding currents are transmitted in the same direction through sections of the inner line electrode and the outer line electrode that are adjacent and parallel to each other.

In the directional coupler according to the first preferred embodiment of the present invention, since the corresponding currents are transmitted in the same direction through the sections of the inner line electrode and the outer line electrode, which are adjacent and parallel to each other, the inductance values of the line electrodes become high. Thus, inductive coupling between the inner line electrode and the outer line electrode becomes strong, and capacitive coupling between the inner line electrode and the outer line electrode becomes weak, thereby achieving high isolation. Moreover, high inductance values can be achieved while the size of the directional coupler is small, and thus the size of the directional coupler can be reduced. Moreover, the inductance values of the inner line electrode and the outer line electrode can be readily adjusted so that the inductance values agree with each other by adjusting the respective numbers of turns of the inner line electrode and the outer line electrode.

A directional coupler according to a second preferred embodiment of the present invention includes at least one dielectric layer and two line electrodes that are provided on the at least one dielectric layer. The two line electrodes include a spiral-shaped or helical-shaped inner line electrode and a spiral-shaped or helical-shaped outer line electrode that surrounds the inner line electrode, as viewed from above.

In the directional coupler according to the second preferred embodiment of the present invention, the inner line electrode and the outer line electrode are formed so as to have a spiral or helical shape. Thus, the corresponding currents are transmitted in the same direction through the sections of the inner line electrode and the outer line electrode, which are adjacent and parallel to each other, and the inductance values of the line electrodes become high. Thus, inductive coupling between the inner line electrode and the outer line electrode becomes strong, and capacitive coupling between the inner line electrode and the outer line electrode becomes weak, thereby achieving high isolation. Moreover, high inductance values can be achieved while the size of the directional coupler is small, and thus the size of the directional coupler can be reduced. Moreover, the inductance values of the inner line electrode and the outer line electrode can be readily adjusted so that the inductance values agree with each other by adjusting the respective numbers of turns of the inner line electrode and the outer line electrode.

In the directional couplers according to the first and second preferred embodiments of the present invention, since the degree of inductive coupling between the inner line electrode and the outer line electrode is high, the length of each of the inner line electrode and the outer line electrode can be kept to less than a quarter of a wavelength. Thus, the size of the directional coupler can be further reduced.

Moreover, in the directional couplers according to the first and second preferred embodiments of the present invention, it is preferable that the width of the inner line electrode is smaller than the width of the outer line electrode. When the width of the inner line electrode is reduced, the inductance value of the inner line electrode is increased. Accordingly, even when the number of turns of the inner line electrode is reduced, the inductance values of the inner line electrode and the outer line electrode can be adjusted so that the inductance values agree with each other. Thus, the size of the directional coupler can be further reduced.

Moreover, the number of turns of the inner line electrode may be larger than the number of turns of the outer line electrode. The inductance values of the inner line electrode and the outer line electrode can be readily adjusted so that the inductance values agree with each other by increasing the number of turns of the inner line electrode.

Moreover, the inner line electrode and the outer line electrode may be provided on the same plane. A first area of the spiral-shaped or helical-shaped outer line electrode opposing the spiral-shaped or helical-shaped inner line electrode, which first area is located inside the outer line electrode, is substantially the same as a second area of the inner edge of the innermost circumferential of the outer line electrode opposing the outer edge of the outermost circumferential of the inner line electrode. Thus, only certain sections of the inner line electrode oppose sections of the outer line electrode in the first area. Moreover, the thickness of the inner line electrode and the outer line electrode is fairly small. Thus, the capacitance between the inner line electrode and the outer line electrode is small, and the degree of isolation between these line electrodes can be significantly increased.

Moreover, the inner line electrode and the outer line electrode may be provided on different planes. The capacitance between the inner line electrode and the outer line electrode can be further reduced by providing the inner line electrode and the outer line electrode on different planes. Thus, the degree of isolation between these line electrodes can be further increased.

Moreover, at least one of the inner line electrode and the outer line electrode may be divided into line electrode components that are provided on a plurality of planes, and the divided line electrode components may be connected in series with each other through a via hole. When the inner line electrode and/or the outer line electrode are divided into line electrode components that are provided on a plurality of planes, the number of line electrode components per unit area that are provided on one plane can be reduced. Thus, the size of the directional coupler can be further reduced.

Moreover, the directional coupler according to preferred embodiments of the present invention may further include a ground electrode that is provided on the dielectric layer. Capacitances may be formed between the ground electrode and individual ends of the inner line electrode and the outer line electrode. Due to the functions of the capacitances formed between the ground electrode and the individual ends of the inner line electrode and the outer line electrode, the resonant frequencies of the inner line electrode and the outer line electrode can be reduced. Thus, the size of the directional coupler can be further reduced by shortening the lengths of the line electrodes to obtain a predetermined resonant frequency.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Directional couplers according to preferred embodiments of the present invention will now be described with reference to the attached drawings.

First Preferred Embodiment

Figure 1:
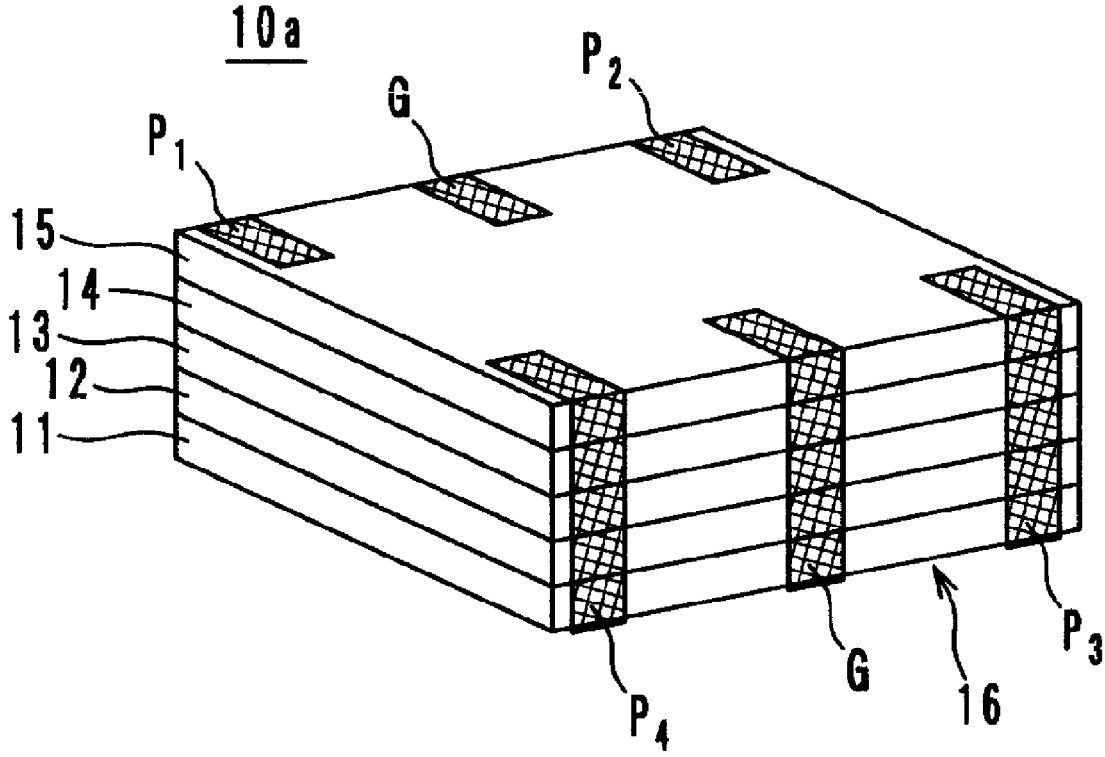
FIG. 1 is a perspective view showing the external appearance of a directional coupler according to a first preferred embodiment of the present invention.
Figure 2:
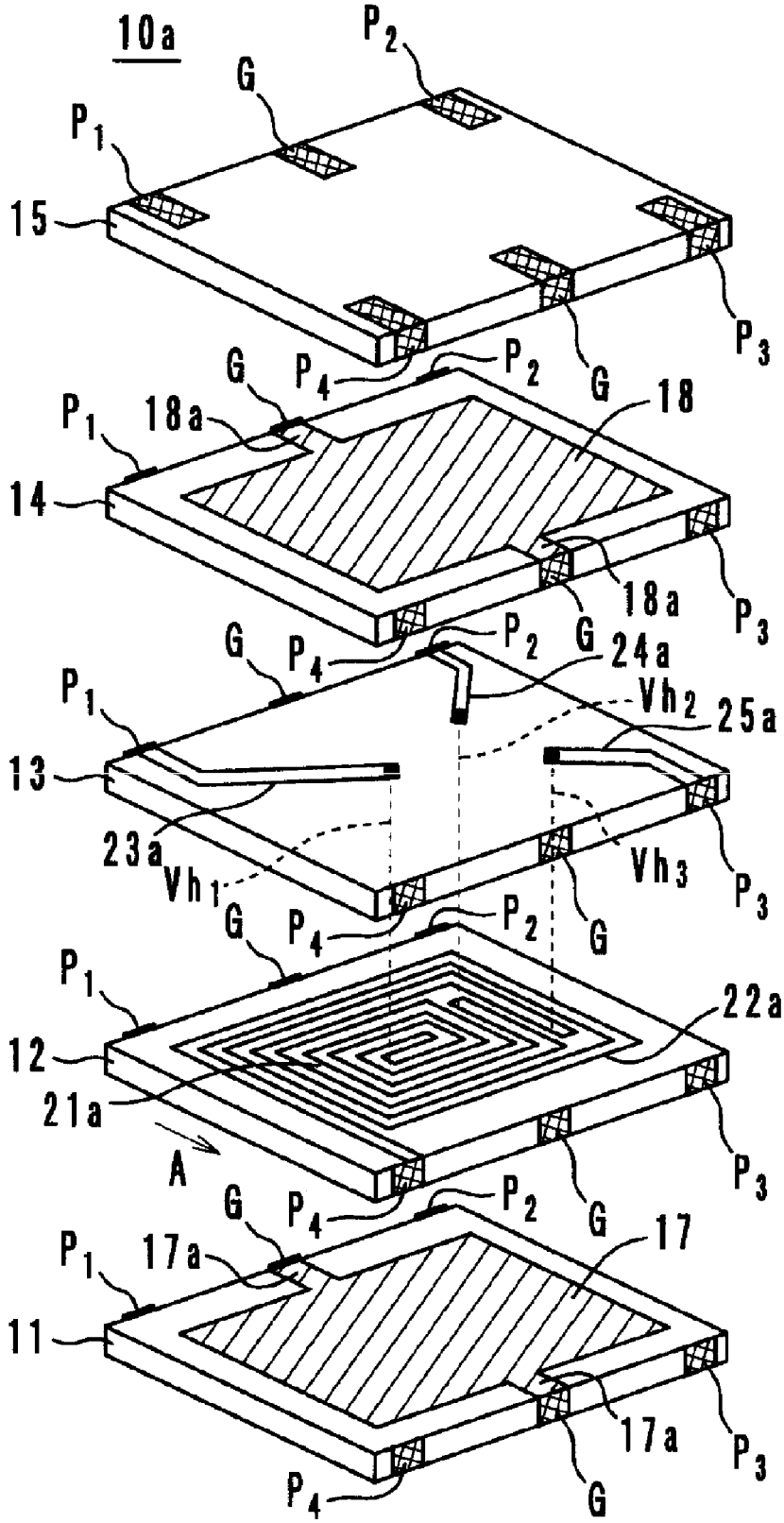
FIG. 2 is an exploded perspective view showing the structure of the directional coupler shown in FIG. 1.

FIGS. 1 and 2 show the external appearance and the exploded structure of a directional coupler 10*a* according to a first preferred embodiment of the present invention, respectively. The directional coupler 10*a* includes a chip laminate body 16 including a first ground electrode substrate 11, a dielectric substrate 12 that includes an inner line electrode 21*a* and an outer line electrode 22*a* that have a spiral shape on one major surface thereof, a lead-out conductor substrate 13 that includes lead-out conductors 23*a*, 24*a*, and 25*a* of the inner line electrode 21*a* and the outer line electrode 22*a* provided thereon, a second ground electrode substrate 14, and a protection substrate 15.

External electrodes G for grounding, external electrodes $P_1$ and $P_2$ for a main line, and external electrodes $P_3$ and $P_4$ for a subordinate line are provided on side surfaces of the laminate body 16 so as to extend from the first ground electrode substrate 11 to the protection substrate 15.

The substrates 11, 12, 13, 14, and 15 are composed of ceramic green sheets that are formed of dielectric ceramic materials by using, for example, the doctor blade method or the Czochralski method, and are laminated into the laminate body 16 and sintered.

Thus, in practice, in FIG. 1, a separating line does not appear between the substrates 11, 12, 13, 14, and 15 in the direction in which these substrates are laminated. The aforementioned external electrodes G, $P_1$, $P_2$, $P_3$, and $P_4$ may be formed after the laminate body 16 has been sintered.

A ground electrode 17 is provided on the major surface of the first ground electrode substrate 11. The size of the ground electrode 17 is such that the ground electrode 17 completely covers the inner line electrode 21*a* and the outer line electrode 22*a*, which have a spiral shape and are provided on the dielectric substrate 12, excluding the peripheral region of the major surface of the first ground electrode substrate 11. The ground electrode 17 is connected to the external electrodes G, G for grounding through lead-out portions 17*a*, 17*a*.

The inner line electrode 21*a* functioning as a main line and the outer line electrode 22*a* functioning as a subordinate line are provided by printing on the major surface of the dielectric substrate 12 at a stage in which the dielectric substrate 12 is a green sheet that has not been sintered. In the first preferred embodiment, the inner line electrode 21*a* and the outer line electrode 22*a* preferably have substantially the same width, and the respective numbers of turns of the inner line electrode 21*a* and the outer line electrode 22*a* are 2.5 and 1.5, respectively. The line length of each of the main and subordinate lines is less than a quarter of a wavelength.

The lead-out conductors 23*a*, 24*a*, and 25*a* are provided on the major surface of the lead-out conductor substrate 13. The inner end of the inner line electrode 21*a* having a spiral shape is connected to the external electrode $P_1$ for the main line through a via hole $Vh_1$ and the lead-out conductor 23*a*, which are provided in the lead-out conductor substrate 13, and the outer end of the inner line electrode 21*a* is connected to the external electrode $P_2$ for the main line through a via hole $Vh_2$ and the lead-out conductor 24*a*, which are provided in the lead-out conductor substrate 13.

The inner end of the outer line electrode 22*a* having a spiral shape is connected to the external electrode $P_3$ for the subordinate line through a via hole $Vh_3$ and the lead-out conductor 25*a*, which are provided in the lead-out conductor substrate 13, and the outer end of the outer line electrode 22*a* is connected directly to the external electrode $P_4$ for the subordinate line on the dielectric substrate 12.

A ground electrode 18 is provided on the major surface of the second ground electrode substrate 14 laminated on the lead-out conductor substrate 13. The size of the ground electrode 18 is such that the ground electrode 18 completely covers the two line electrodes 21*a* and 22*a*, which have a spiral shape and are provided on the dielectric substrate 12, excluding the peripheral region of the major surface of the second ground electrode substrate 14. The ground electrode 18 is connected to the external electrodes G for grounding through lead-out portions 18*a*. The ground electrode 18 is covered with the protection substrate 15 which is laminated on the second ground electrode substrate 14.

In the directional coupler 10*a* having the aforementioned structure, the outer line electrode 22*a* having a spiral shape and the inner line electrode 21*a* having a spiral shape are coupled by side-edge coupling therebetween. The inner line electrode 21*a* is surrounded by the outer line electrode 22*a* and disposed inside the outer line electrode 22*a*. An enclosed area between the inner line electrode 21*a* and the outer line electrode 22*a* is substantially the same as an enclosed area between the inner edge of the innermost circumferential of the outer line electrode 22*a* and the outer edge of the outermost circumferential of the inner line electrode 21*a*. Thus, only certain sections of the inner line electrode 21*a* oppose sections of the outer line electrode 22*a* in the first area. Moreover, since the inner line electrode 21*a* and the outer line electrode 22*a* are formed by printing, the thickness of each line electrode is thin. Thus, the capacitance formed between the inner line electrode 21*a* and the outer line electrode 22*a* is small, and high isolation between these line electrodes can be achieved.

Moreover, in the directional coupler 10*a*, the inner line electrode 21*a* and the outer line electrode 22*a* have a spiral shape. In FIG. 2, for example, the corresponding currents are transmitted through parallel front left sections of the inner line electrode 21*a* and the outer line electrode 22*a* in the same direction, as indicated by arrow A. Thus, the inductance values of the line electrodes 21*a* and 22*a* become high at sections of the inner line electrode 21*a* and the outer line electrode 22*a*. Accordingly, inductive coupling between the inner line electrode 21*a* and the outer line electrode 22*a* becomes strong and capacitive coupling between the inner line electrode 21*a* and the outer line electrode 22*a* becomes weak. Moreover, the inductance values of the inner line electrode 21*a* and the outer line electrode 22*a* can be readily adjusted so that the inductance values agree with each other by adjusting the respective numbers of turns of the inner line electrode 21*a* and the outer line electrode 22*a*.

In the directional coupler 10*a*, the inner line electrode 21*a* and the outer line electrode 22*a* have a spiral shape, and the corresponding currents are transmitted through the sections of the inner line electrode 21*a* and the outer line electrode 22*a* that are parallel and adjacent to each other in the same direction. Thus, a high inductance value can be achieved while the size of the directional coupler 10*a* is small. The length of each line electrode can be less than a quarter of a wavelength, and the size of the directional coupler 10*a* can be reduced.

In the aforementioned description of the directional coupler 10*a*, the inner line electrode 21*a* is the main line electrode and the outer line electrode 22*a* is the subordinate line electrode. Even when the inner line electrode 21*a* is the subordinate line and the outer line electrode 22*a* is the main line, the directional coupler 10*a* can operate in the same manner. The same applies to the remaining preferred embodiments, which are described below.

Second Preferred Embodiment

Figure 3:
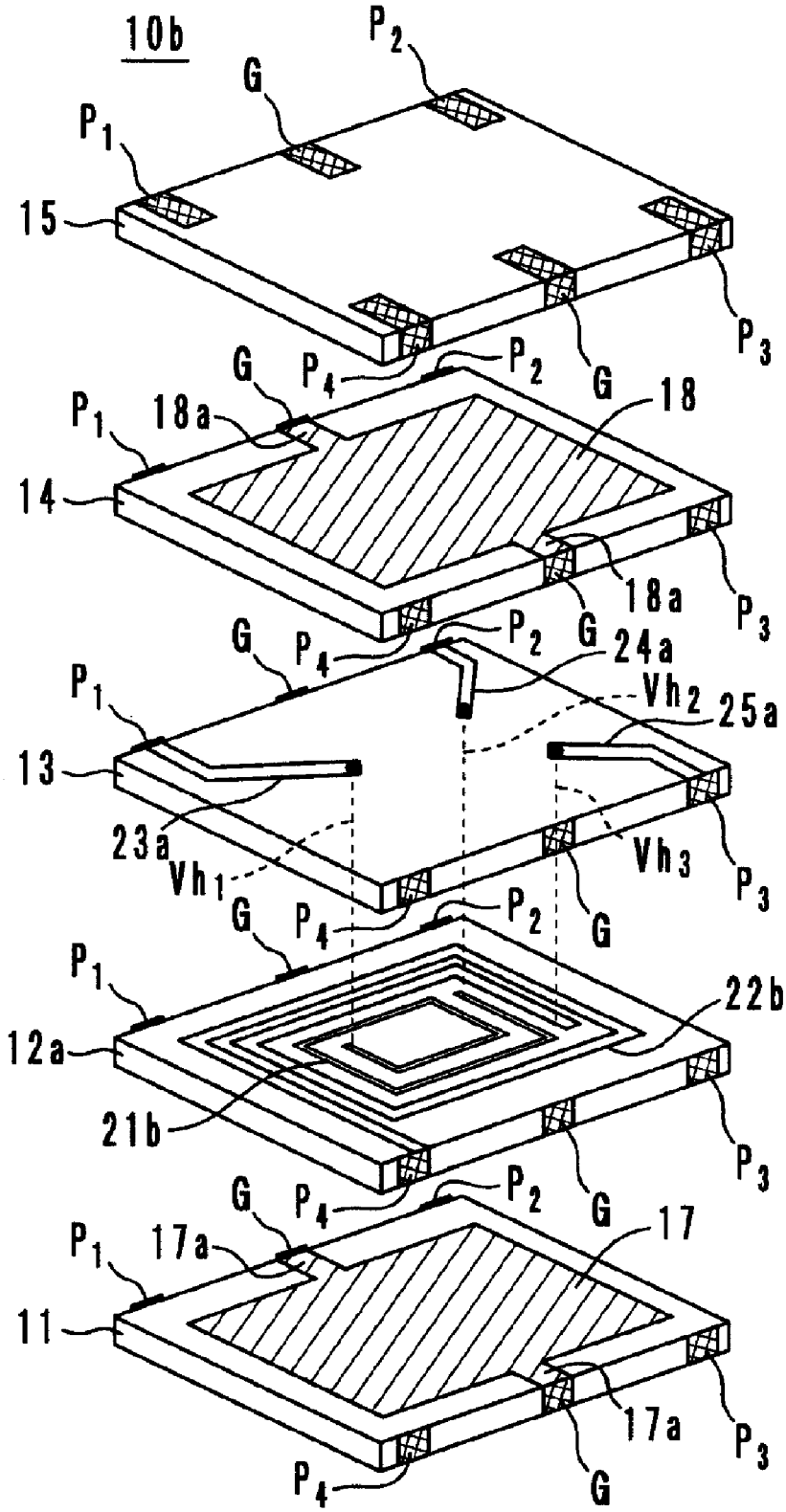
FIG. 3 is an exploded perspective view of a directional coupler according to a second preferred embodiment of the present invention.

FIG. 3 shows a directional coupler 10*b* according to a second preferred embodiment of the present invention. While the dielectric substrate 12 is used in the directional coupler 10*a* according to the first preferred embodiment, which was described with reference to FIGS. 1 and 2, wherein the inner line electrode 21*a* and the outer line electrode 22*a* preferably have substantially the same width on the dielectric substrate 12; a dielectric substrate 12*a* is used in the directional coupler 10*b*, an inner line electrode 21*b* and an outer line electrode 22*b* are provided on the dielectric substrate 12*a* so that the width of the inner line electrode 21*b* is narrower than that of the outer line electrode 22*b*.

When the width of the inner line electrode 21*b* is narrower, the inductance value of the inner line electrode 21*b* is increased. Accordingly, the number of turns of the inner line electrode 21*b* can be reduced. Thus, a directional coupler 10*b* that is smaller than the directional coupler 10*a* can be obtained.

In FIG. 3, the same reference letters and numerals as in FIG. 2 are assigned to the corresponding components, and duplicate description thereof is omitted. The advantages achieved by the second preferred embodiment are basically the same as those achieved by the first preferred embodiment.

Third Preferred Embodiment

Figure 4:
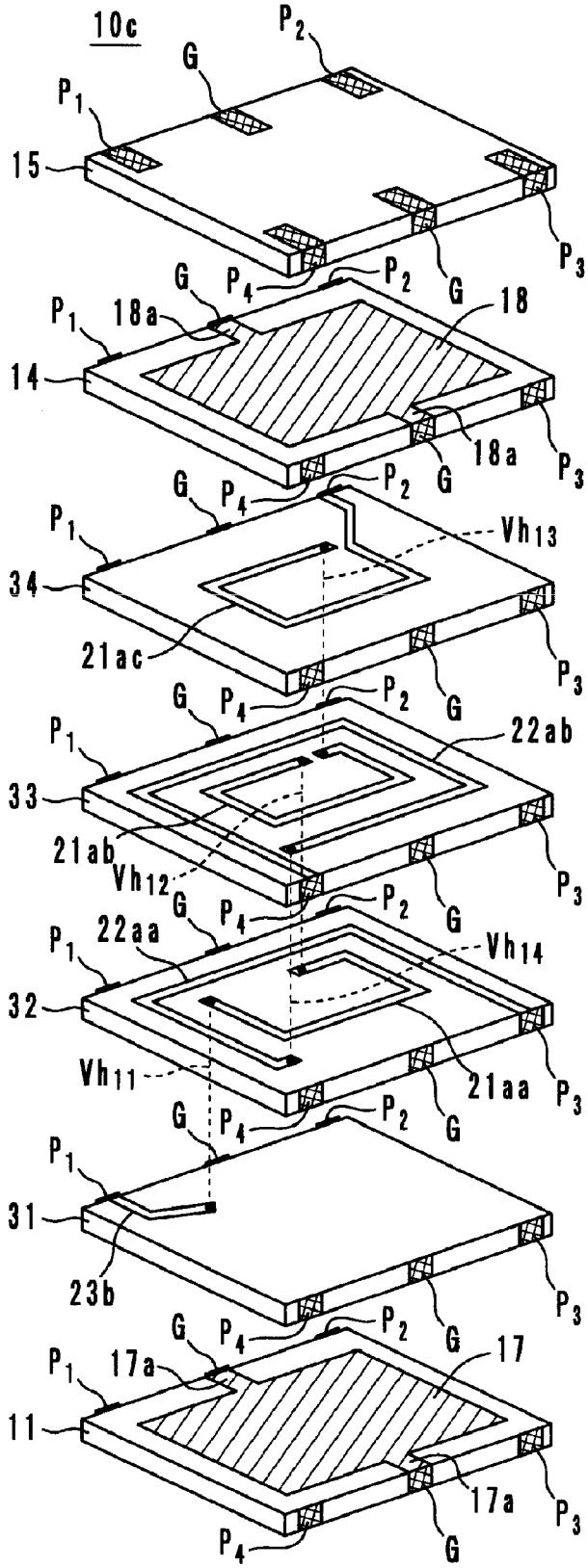
FIG. 4 is an exploded perspective view of a directional coupler according to a third preferred embodiment of the present invention.

FIG. 4 shows a directional coupler according to a third preferred embodiment of the present invention. While the dielectric substrate 12 is used in the directional coupler 10*a* according to the first preferred embodiment, which was described with reference to FIGS. 1 and 2, wherein the inner line electrode 21*a* and the outer line electrode 22*a* preferably have substantially the same width on the dielectric substrate 12; dielectric substrates 32, 33, and 34 are used in the directional coupler 10*c*. Three inner line electrode components 21*aa*, 21*ab*, and 21*ac*, into which the inner line electrode is divided, are respectively provided on the dielectric substrates 32, 33, and 34; and two outer line electrode components 22*aa* and 22*ab*, into which the outer line electrode is divided, are respectively provided on the dielectric substrates 32 and 33. When this arrangement is utilized, the inner line electrode and the outer line electrode are formed as helical lines.

In FIG. 4, the same reference letters and numerals as in FIG. 2 are assigned to the corresponding components, and duplicate description thereof is omitted.

One end of the inner line electrode component 21*aa* is connected through a via hole $Vh_{11}$ in the dielectric substrate 32 to a lead-out conductor 23*b* on a lead-out conductor substrate 31 and the external electrode $P_1$ for the main line. The other end of the inner line electrode component 21*aa* is connected through a via hole $Vh_{12}$ in the dielectric substrate 33 to one end of the inner line electrode component 21*ab* on the dielectric substrate 33.

The other end of the inner line electrode component 21*ab* is connected through a via hole $Vh_{13}$ in the dielectric substrate 34 to one end of the inner line electrode component 21*ac* on the dielectric substrate 34. The other end of the inner line electrode component 21*ac* is connected directly to the external electrode $P_2$ for the main line on the dielectric substrate 34.

On the other hand, one end of the outer line electrode component 22*aa* is connected directly to the external electrode $P_3$ for the subordinate line on the dielectric substrate 32. The other end of the outer line electrode component 22*aa* is connected through a via hole $Vh_{14}$ in the dielectric substrate 33 to one end of the outer line electrode component 22*ab* on the dielectric substrate 33. The other end of the outer line electrode component 22*ab* is connected directly to the external electrode $P_4$ for the subordinate line on the dielectric substrate 33.

Even when this arrangement is utilized, the same advantages as in the directional coupler 10*a*, which was described with reference to FIGS. 1 and 2, can be achieved. As is apparent from FIG. 4, the inner line electrode is divided into the three inner line electrode components 21*aa*, 21*ab*, and 21*ac*, and the outer line electrode is divided into the two outer line electrode components 22*aa* and 22*ab*. Thus, the number of line electrode components per unit area that are on the dielectric substrates 32, 33, and 34 can be reduced, and the size of the directional coupler can be further reduced.

Fourth Preferred Embodiment

Figure 5:
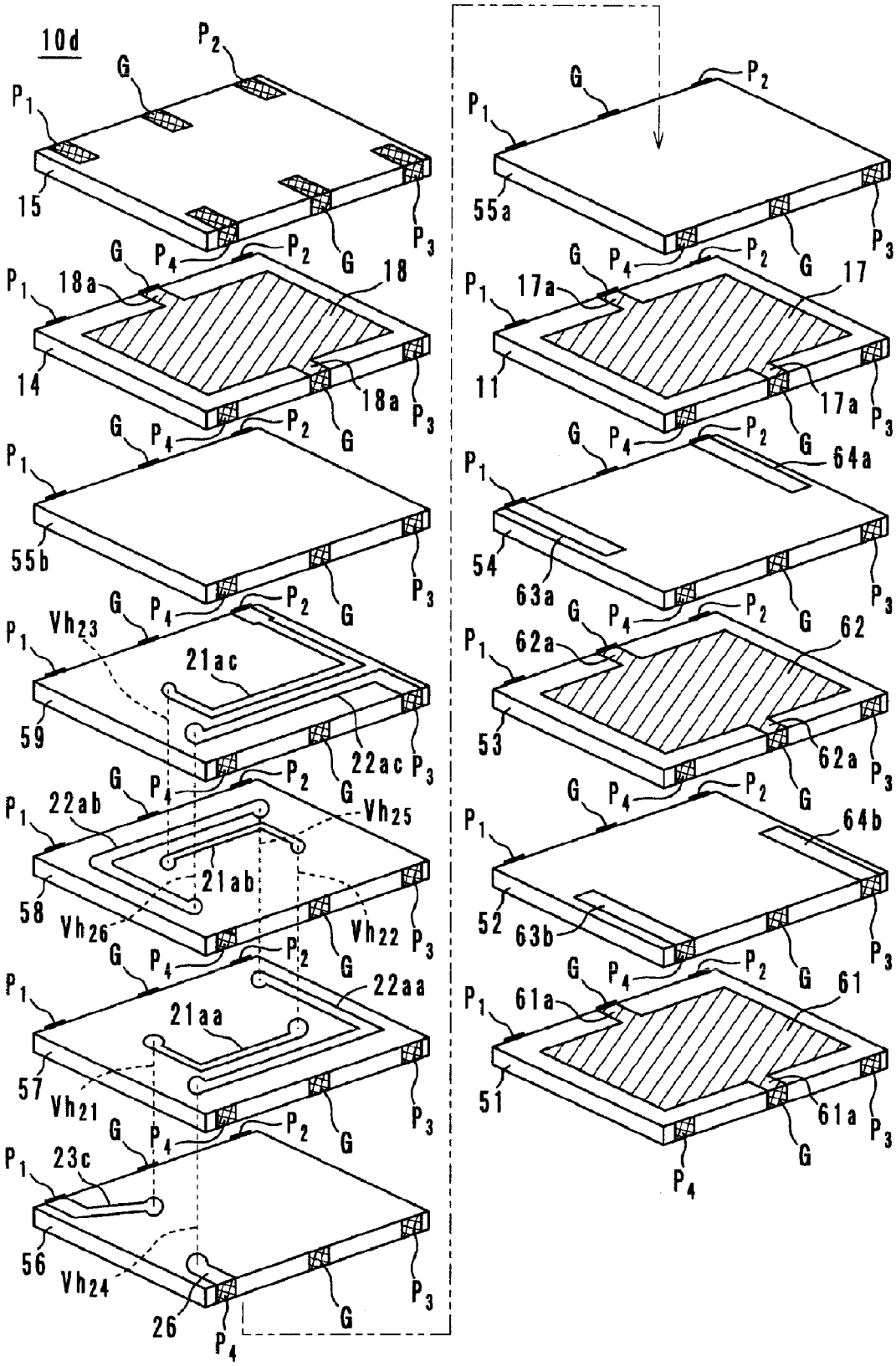
FIG. 5 is an exploded perspective view of a directional coupler according to a fourth preferred embodiment of the present invention.
Figure 6:
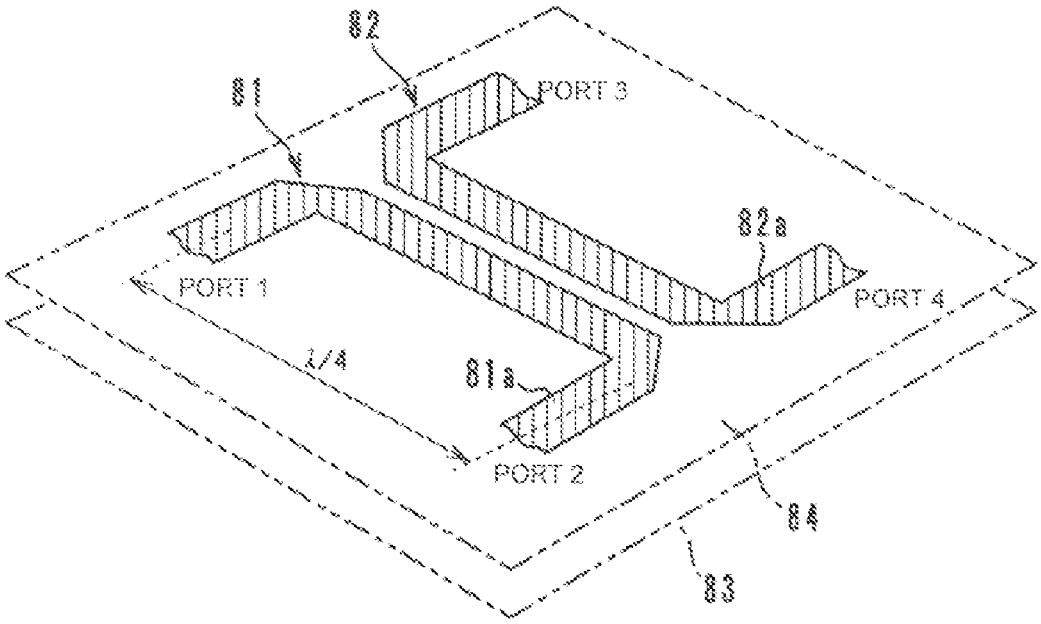
FIG. 6 PRIOR ART
FIG. 6 shows a conventional directional coupler.
Figure 7:
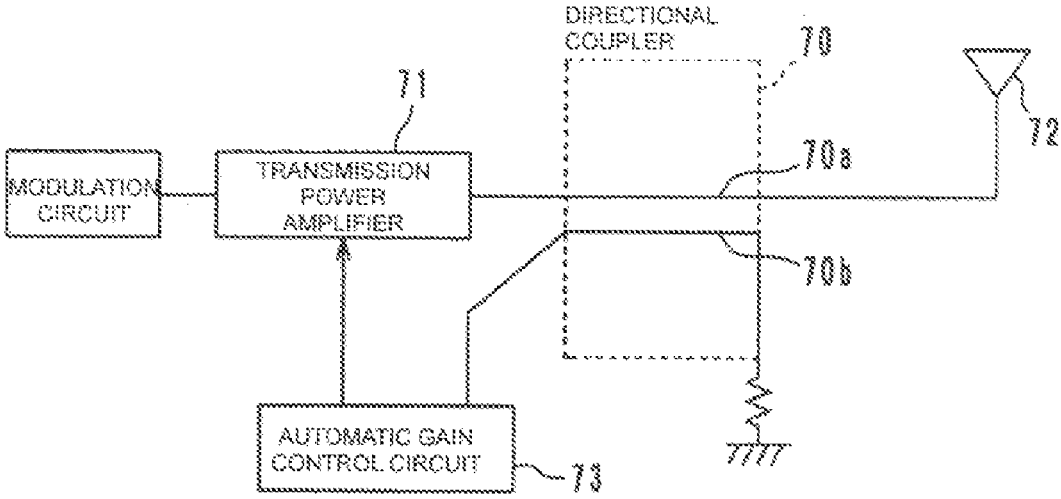
FIG. 7 PRIOR ART
FIG. 7 is a block diagram showing an RF transmitter circuit in which a directional coupler is used.

FIG. 5 shows a directional coupler 10*d* according to a fourth preferred embodiment of the present invention. In the directional coupler 10*d*, the inner line electrode is divided into three inner line electrode components 21*aa*, 21*ab*, and 21*ac*, and the outer line electrode is divided into three outer line electrode components 22*aa*, 22*ab*, and 22*ac*, as in the directional coupler 10*c* according to the third preferred embodiment, which was described with reference to FIG. 4. These line electrode components are provided on three dielectric substrates 57, 58, and 59. Capacitances are formed between the external electrodes $P_1$ to $P_4$ for the main and subordinate lines and the external electrodes G for grounding.

One end of the inner line electrode component 21*aa* is connected through a via hole $Vh_{21}$ in the dielectric substrate 57 to a lead-out conductor 23*c* on a lead-out conductor substrate 56 and the external electrode $P_1$ for the main line. The other end of the inner line electrode component 21*aa* is connected through a via hole $Vh_{22}$ in the dielectric substrate 58 to one end of the inner line electrode component 21*ab* on the dielectric substrate 58. The other end of the inner line electrode component 21*ab* is connected through a via hole $Vh_{23}$ in the dielectric substrate 59 to one end of the inner line electrode component 21*ac* on the dielectric substrate 59. The other end of the inner line electrode component 21*ac* is connected directly to the external electrode $P_2$ for the main line on the dielectric substrate 59.

On the other hand, one end of the outer line electrode component 22*aa* is connected through a via hole $Vh_{24}$ in the dielectric substrate 57 to a lead-out conductor 26 on the lead-out conductor substrate 56 and the external electrode $P_4$ for the subordinate line. The other end of the outer line electrode component 22*aa* is connected through a via hole $Vh_{25}$ in the dielectric substrate 58 to one end of the outer line electrode component 22*ab* on the dielectric substrate 58. The other end of the outer line electrode component 22*ab* is connected through a via hole $Vh_{26}$ in the dielectric substrate 59 to one end of the outer line electrode component 22*ac* on the dielectric substrate 59. The other end of the outer line electrode component 22*ac* is connected directly to the external electrode $P_3$ for the subordinate line on the dielectric substrate 59.

A dummy substrate 55*a* is laminated between the lead-out conductor substrate 56 and the ground electrode substrate 11, and a dummy substrate 55*b* is laminated between the dielectric substrate 59 and the ground electrode substrate 14. In the directional coupler 10*d*, capacitor electrode substrates 51 to 54 for forming capacitances are laminated, in this order from the bottom, under the ground electrode substrate 11.

A capacitor electrode 61 is provided on the major surface of the capacitor electrode substrate 51. The capacitor electrode 61 is arranged so that the capacitor electrode 61 covers a substantially entire area of the major surface of the capacitor electrode substrate 51, excluding the peripheral region of the major surface of the capacitor electrode substrate 51. The capacitor electrode 61 is connected to the external electrodes G, G for grounding through lead-out portions 61*a*, 61*a*. Two strip-shaped capacitor electrodes 63*b* and 64*b* are provided on the major surface of the capacitor electrode substrate 52. The capacitor electrodes 63*b* and 64*b* are connected to the external electrodes $P_4$ and $P_3$ for the subordinate line, respectively.

A capacitor electrode 62 is provided on the major surface of the capacitor electrode substrate 53. The capacitor electrode 62 is arranged so that the capacitor electrode 62 covers substantially the entire area of the major surface of the capacitor electrode substrate 53, excluding the peripheral region of the major surface of the capacitor electrode substrate 53. The capacitor electrode 62 is connected to the external electrodes G, G for grounding through lead-out portions 62*a*, 62*a*. Two strip-shaped capacitor electrodes 63*a* and 64*a* are provided on the major surface of the capacitor electrode substrate 54. The capacitor electrodes 63*a* and 64*a* are connected to the external electrodes $P_1$ and $P_2$ for the main line, respectively.

The advantages achieved by the fourth preferred embodiment are the same as those achieved by the first preferred embodiment. Moreover, when the aforementioned arrangement is utilized, capacitances are formed between the capacitor electrodes 63*a* and 64*a*, the capacitor electrode 62, and the ground electrode 17; and between the capacitor electrodes 63*b* and 64*b*, the capacitor electrode 61, and the capacitor electrode 62. Due to the functions of these capacitances, the resonant frequencies of the inner line electrode, which is divided into the three inner line electrode components 21*aa*, 21*ab*, and 21*ac*, and the outer line electrode, which is divided into the three outer line electrode components 22*aa*, 22*ab*, and 22*ac*, can be reduced. Thus, the size of the directional coupler 10*d* can be further reduced by shortening the lengths of the line electrodes to obtain a predetermined resonant frequency.

Other Preferred Embodiments

Directional couplers according to the present invention are not limited to the aforementioned preferred embodiments and can have various structures within the gist and scope of the present invention.

For example, in the directional coupler 10*a*, although not specifically shown in the drawings, the inner line electrode 21*a* may be provided on one dielectric substrate, and the outer line electrode 22*a* may be provided on another dielectric substrate. In this arrangement, the capacitance between the inner line electrode 21*a* and the outer line electrode 22*a* can be reduced, resulting in high isolation between these line electrodes.

The present invention may be applied to directional couplers for a microwave band as described above, and in particular, is excellent in that a high coupling value and high isolation characteristics can be achieved.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A directional coupler comprising:

a first dielectric layer;

a second dielectric layer; and two line electrodes arranged on each of the first and second dielectric layers; wherein the two line electrodes include an inner line electrode and an outer line electrode that surrounds the inner line electrode, as viewed from above, such that only some sections of the inner line electrode oppose some sections of the outer line electrode and remaining sections of the inner line electrode do not oppose remaining sections of the outer line electrode;

a first end of the inner line electrode arranged on the first dielectric layer and a first end of the inner line electrode arranged on the second dielectric layer are connected through a first via hole in the first dielectric layer;

a first end of the outer line electrode arranged on the first dielectric layer and a first end of the outer line electrode arranged on the second dielectric layer are connected through a second via hole in the first dielectric layer; and corresponding currents are transmitted in the same direction through sections of the inner line electrode and the outer line electrode that are adjacent and substantially parallel to each other.

2. A directional coupler comprising:

a first dielectric layer;

a second dielectric layer; and two line electrodes arranged on each of the first and second dielectric layers; wherein the two line electrodes include a spiral-shaped or helical-shaped inner line electrode and a spiral-shaped or helical-shaped outer line electrode that surrounds the inner line electrode, as viewed from above, such that only some sections of the inner line electrode oppose some sections of the outer line electrode and remaining sections of the inner line electrode do not oppose remaining sections of the outer line electrode;

a first end of the inner line electrode arranged on the first dielectric layer and a first end of the inner line electrode arranged on the second dielectric layer are connected through a first via hole in the first dielectric layer; and a first end of the outer line electrode arranged on the first dielectric layer and a first end of the outer line electrode arranged on the second dielectric layer are connected through a second via hole in the first dielectric layer.

3. The directional coupler according to claim 1, further comprising a third dielectric layer and an inner line electrode arranged on the third dielectric layer, wherein a second end of the inner line electrode arranged on the first dielectric layer and a first end of the inner line electrode arranged on the third dielectric layer are connected through a third via hole in the third dielectric layer.

4. The directional coupler according to claim 1, wherein a length of each of the inner line electrode and the outer line electrode is less than a quarter of a wavelength.

5. The directional coupler according to claim 1, wherein a width of the inner line electrode is smaller than a width of the outer line electrode.

6. The directional coupler according to claim 1, wherein a number of turns of the inner line electrode is larger than a number of turns of the outer line electrode.

7. The directional coupler according to claim 1, wherein the inner line electrode and the outer line electrode are arranged on the same plane.

8. The directional coupler according to claim 1, wherein the inner line electrode and the outer line electrode are arranged on different planes.

9. The directional coupler according to claim 1, wherein at least one of the inner line electrode and the outer line electrode is divided into line electrode components arranged on a plurality of planes, and the divided line electrode components are connected in series with each other through the first or the second via hole.

10. The directional coupler according to claim 1, further comprising a fourth dielectric layer and a ground electrode arranged on the fourth dielectric layer, wherein a capacitance is formed between the ground electrode and ends of the inner line electrode and the outer line electrode.

11. The directional coupler according to claim 2, further comprising a third dielectric layer and an inner line electrode arranged on the third dielectric layer, wherein a second end of the inner line electrode arranged on the first dielectric layer and a first end of the inner line electrode arranged on the third dielectric layer are connected through a third via hole in the third dielectric layer.

12. The directional coupler according to claim 2, wherein a length of each of the inner line electrode and the outer line electrode is less than a quarter of a wavelength.

13. The directional coupler according to claim 2, wherein a width of the inner line electrode is smaller than a width of the outer line electrode.

14. The directional coupler according to claim 2, wherein a number of turns of the inner line electrode is larger than a number of turns of the outer line electrode.

15. The directional coupler according to claim 2, wherein the inner line electrode and the outer line electrode are arranged on the same plane.

16. The directional coupler according to claim 2, wherein the inner line electrode and the outer line electrode are arranged on different planes.

17. The directional coupler according to claim 2, wherein at least one of the inner line electrode and the outer line electrode is divided into line electrode components arranged on a plurality of planes, and the divided line electrode components are connected in series with each other through the first or the second via hole.

18. The directional coupler according to claim 2, further comprising a fourth dielectric layer and a ground electrode arranged on the fourth dielectric layer, wherein a capacitance is formed between the ground electrode and ends of the inner line electrode and the outer line electrode.

* * * * *